US005617882A

United States Patent [19]

Bushuev et al.

[11] Patent Number: 5,617,882

[45] Date of Patent: Apr. 8, 1997

[54] TOBACCO SMOKING ARTICLE FILTER WITH BASALT FIBERS

[75] Inventors: Jury G. Bushuev; Stanislav P. Polovnikov, both of Moscow; Foat A.-K. Fekhretdinov, Moskovskaya oblast; Sergei A. Karaoglanov, Moscow; Zhanna S. Ivanenko, Moskovskaya oblast, all of Russian Federation

[73] Assignee: Nauchno-Proizvodstvennoe Obiedinenie "Kompozit", Moskovskaya, Russian Federation

[21] Appl. No.: 333,283

[22] Filed: Nov. 2, 1994

[51] Int. Cl.[6] ..... A24D 1/04; A24D 3/14

[52] U.S. Cl. ..... 131/331; 131/341; 131/342

[58] Field of Search ..... 131/331, 341, 131/342; 55/242, 252, 255, 256, 466, 467, 482, 484, 487

[56] References Cited

U.S. PATENT DOCUMENTS

| | | |
|---|---|---|
| 2,108,860 | 2/1938 | Kauffman . |
| 3,313,306 | 4/1967 | Berger et al. . |
| 4,334,900 | 6/1982 | Neumann . |
| 4,432,777 | 2/1984 | Postma . |
| 4,729,389 | 3/1988 | Anderson . |
| 4,859,405 | 8/1989 | Squarer et al. . |

FOREIGN PATENT DOCUMENTS

| | | |
|---|---|---|
| 3413362 | 2/1989 | Germany . |

*Primary Examiner*—Jennifer Bahr
*Attorney, Agent, or Firm*—Ladas & Parry

[57] ABSTRACT

The invention concerns a tobacco smoking article comprising a tobacco rod and a filter unit containing both organic and inorganic fibers wherein the inorganic fibers are basalt fibers with diameter of no more than 0.6 μm.

4 Claims, No Drawings

TOBACCO SMOKING ARTICLE FILTER WITH BASALT FIBERS

FIELD OF THE INVENTION

The present invention concerns tobacco smoking articles of a cigarette type comprising a tobacco rod and a filter unit with a fiber filter.

BACKGROUND OF THE INVENTION

There are many known kinds of tobacco smoking articles with filters for removal of nicotine and tar from tobacco smoke by mechanical entrapment of such substances.

The most commercially available at the present time are filter units comprising fibers of thermoplastic organic substances. Such fibers are usually packed in a variety of ways and have a diameter less than 10 μm. For example, there are filters comprising cellulose acetate and polyamide fibers (cf., DE 3,413,362, Int.Cl. A 24 D 3/04, 1984).

The main disadvantage of the prior art filters with thermoplastic organic fiber is inadequate removal of nicotine and tar from tobacco smoke. Thus, the standard filter made of organic fibers provides a nicotine content in the condensate of up to 1.46 mg/cig with a packing density of tobacco of 128 kg/m$^3$, and a tar content of up to 19.9 mg/cig, while the international normal values of nicotine and tobacco contents in the condensate are 0.6–1.0 and 6–15 mg/cig, respectively.

Therefore, attempts have been made to improve the effectiveness of entrapping nicotine and tar using inorganic fibers. One of such attempts is a filter disclosed in U.S. Pat. No. 4,729,389, Int.Cl. A 24 D 3/08, 1988. This Patent discloses a tobacco smoking article with a filter comprising an inorganic kaolin fiber having a diameter of from 1 to 5 μm. The fiber contains alumina and silica in an amount of from about 95 to about 99.5 percent by weight.

The all-kaolin filter is uncomfortable in that, in smoking the cigarettes provided with such a filter, a smoker will draw, together with smoke, kaolin particles present in the mass of kaolin fibers. As a consequence, U.S. Pat. No. 4,729,389 proposes, as a preferred embodiment, a filter unit which consists of two parts: a first part, facing a tobacco rod, containing a kaolin fiber, and a second part, facing a smoker, made of a standard organic fiber. This embodiment achieves an improved entrapment of the nicotine and tar through the first part of filter with a subsequent entrapment of the kaolin particles from smoke. This filter unit has a total (standard) length of 27 mm. The kaolin part length of 6 mm provides a nicotine and tar content in the condensate of 0.89 and 10.71 mg/cig, respectively.

However, production of such filter units is fraught with difficulties. As a practical matter, industrial manufacture of an endless filter rod requires assembly from alternating kaolin and organic parts. The kaolin inorganic fiber becomes badly plastified, so it is difficult to maintain precise parameters of the kaolin parts (length, density, diameter) in industrial production.

SUMMARY OF THE INVENTION

In line with the foregoing, the present invention has several aspects.

In a first aspect, the present invention provides a tobacco smoking article with an inorganic fiber comprising a super-fine basalt fiber that improves smoke removal effectiveness.

This enables reduction of the quantity of inorganic fiber per individual filter.

In a second aspect, the present invention solves the problem of simplifying the manufacture of a filter containing organic and inorganic fibers by making it possible to manufacture the filter from organic fiber comprising basalt fibers.

DETAILED DESCRIPTION OF THE INVENTION

The invention provides a tobacco smoking article comprising a tobacco rod and a filter unit containing both organic and inorganic fibers wherein the inorganic fibers are basalt fibers with diameter of no more than 0.6 μm.

Preferably, the basalt fiber content in the filter is of from 1 to 1.5 mg.

The filter unit according to the invention may be made of two parts, one containing organic fibers, and the other containing said basalt fibers. The inorganic part contains the basalt fibers facing the tobacco rod.

In an alternative embodiment, the smoking article contains a filter unit made of an organic fiber comprising basalt fibers. For example, a core of such a filter unit may contain a filter paper with a cellulose acetate fiber and comprising basalt fibers in an amount of from 1 to 1.5 mg per individual filter unit.

The super-fine basalt fiber with diameter of fibers of no more than 0.6 μm has high specific surface which provides for effective entrapment of tar and nicotine without increasing the force needed by a smoker to overcome filter resistance during draw. Effective filtration together with good drawability are further advantages of the invention.

The super-fine basalt fibers are produced from natural basalt raw material by a method of blowing a melt that flows out of spinnerets. The final product represents a mass of a density of from 10 to 20 kg/m$^3$ with unidirectional fibers having a diameter of no more than 0.6 μm.

The approximate composition according to chemical analysis of the basalt fibers, % by weight, is as follows: $SiO_2$-46.8; $Al_2O_3$-16.96; CaO-10.0; FeO-8.08; MgO-6.34; $Fe_2O_3$-5.5

EXAMPLES

To determine an optimum amount of the basalt fiber in the individual filter, a sheet was manufactured from a basalt mat by the process used in production of paper. The filter unit ("the insert") was manufactured from the resultant sheet with a size corresponding to the diameter of a standard filter. The insert contained the basalt fibers in an amount of from 1 to 1.5 mg.

The insert was placed in the cigarette between the tobacco rod and a standard filter made of an acetate fiber.

The absorption capability of the samples containing the basalt fibers of different weights was tested in accordance with the procedure described in the International Standard (ISO), said procedure providing:

1. Smoking cigarettes on the rotor automation RMF 20Mr BORGWALDT.

2. Distilling alkaloids from the condensate of smoke.

3. Precipitation of the condensate by the method of Cambridge filter.

4. Spectrum analysis in the ultraviolet region of light.

The results of the tests are shown in Table I. The data on the nicotine and tar content in the condensate in using the filter according to U.S. Pat. No. 4,729,389 and in the condensate produced in smoking cigarettes of Russian origin with the standard acetate filter are shown in said Table I as well.

TABLE I

| Index | Basalt fiber content in the filter, mg | | | | | Filter according to U.S. Pat. No. | Acetate filter of Russian | International normal |
|---|---|---|---|---|---|---|---|---|
| (mg/cig) | 0.5 | 1.0 | 1.3 | 1.5 | 1.8 | 4,729,389 | origin | value |
| Wet condensate | 15.3 | 12.9 | 12.0 | 12.3 | 9.4 | *) | 18.0 | |
| Moisture | 1.97 | 1.50 | 1.20 | 1.30 | 1.00 | *) | 2.5 | |
| Dry condensate | 13.6 | 11.4 | 10.8 | 11.0 | 8.4 | *) | 15.5 | |
| Nicotine | 0.9 | 0.62 | 0.6 | 0.6 | 0.48 | 0.89 | 101 | 0.6–1.0 |
| Tar | 11.0 | 10.7 | 10.3 | 10.4 | 10.0 | 10.71 | 23.9 | 6–15 |

*) The tests were not carried out; the values of the nicotine and tar content were taken from U.S. Pat. No. 4,729,389.

It is possible to make the following conclusions from the results of the tests described above.

The filter according to the invention, containing the basalt fiber, has a nicotine and tar entrapping effectiveness which is considerably more than that of the most effective prior art filters with inorganic fiber. With the invention, considerably less quantity of the inorganic fiber (it may be less by a factor of up to 10) is required to entrap the same quantity of nicotine.

This shows that, with the invention, it is possible to produce cigarettes having a filter with a high drawability, and yet which effectively entraps the undesirable substances.

What is claimed:

1. A tobacco smoking article comprising a tobacco rod and a filter unit containing both organic and inorganic fibers wherein the inorganic fibers are basalt fibers with diameter of no more than 0.6 Mm.

2. A tobacco smoking article according to claim 1 wherein the basalt fiber content in the filter is from 1 to 15 mg.

3. A tobacco smoking article according to claim 1 wherein the filter unit is made of two parts, a first part containing the organic fibers, and a second part containing said basalt fibers, the second part containing the basalt fibers facing the tobacco rod.

4. A tobacco smoking article according to claim 2, wherein the filter unit is made of two parts, a first part containing the organic fibers, and a second part containing said basalt fibers, the second part containing the basalt fibers facing the tobacco rod.

* * * * *